US005194142A

United States Patent [19]

Forester

[11] Patent Number: 5,194,142

[45] Date of Patent: Mar. 16, 1993

[54] METHOD FOR CONTROLLING FOULING DEPOSIT FORMATION IN A LIQUID HYDROCARBONACEOUS MEDIUM

[75] Inventor: David R. Forester, Conroe, Tex.

[73] Assignee: Betz Laboratories, Inc., Trevose, Pa.

[21] Appl. No.: 750,118

[22] Filed: Aug. 26, 1991

[51] Int. Cl.[5] ..... C10G 9/12; C10G 9/16

[52] U.S. Cl. ..... 208/48 AA; 208/48 R; 585/950

[58] Field of Search ..... 208/48 AA, 48 R; 585/950

[56] References Cited

U.S. PATENT DOCUMENTS

| | | | |
|---|---|---|---|
| 3,172,892 | 3/1965 | Le Suer et al. | 260/326.5 |
| 3,235,484 | 2/1966 | Colfer | 208/48 |
| 3,437,583 | 4/1969 | Gonzalez | 208/48 |
| 4,177,041 | 12/1979 | Sung et al. | 44/71 |
| 4,204,841 | 5/1980 | Biasotti et al. | 44/71 |
| 4,248,719 | 2/1981 | Chafetz et al. | 252/34 |
| 4,578,178 | 3/1986 | Forester | 208/48 |
| 4,579,675 | 4/1986 | Sawicki et al. | 252/51.5 A |
| 4,775,459 | 10/1988 | Forester | 208/48 |
| 4,883,886 | 11/1989 | Huang | 549/255 |

*Primary Examiner*—Theodore Morris
*Assistant Examiner*—Walter D. Griffin
*Attorney, Agent, or Firm*—Alexander D. Ricci; Bruce E. Peacock

[57] ABSTRACT

Enaminones of polyalkenylsuccinimides are used as effective antifoulants in liquid hydrocarbonaceous mediums, such as crude oils and gas oils, during processing of such liquids at elevated temperatures. The enaminones are formed via reaction of polyalkenylsuccinimide and a dicarbonyl compound. The polyalkenylsuccinimide intermediate is first formed via reaction of polyalkenylsuccinic anhydride and polyamine.

8 Claims, No Drawings

METHOD FOR CONTROLLING FOULING DEPOSIT FORMATION IN A LIQUID HYDROCARBONACEOUS MEDIUM

FIELD OF THE INVENTION

The present invention pertains to the use of enaminones of polyalkenyl succinimides to inhibit fouling in liquid hydrocarbon mediums during the heat treatment processing of the medium, such as in refinery processes.

BACKGROUND OF THE INVENTION

In the processing of petroleum hydrocarbons and feedstocks, such as petroleum processing intermediates, and petrochemicals and petrochemical intermediates, e.g., gas, oils and reformer stocks, chlorinated hydrocarbons and olefin plant fluids, such as deethanizer bottoms, the hydrocarbons are commonly heated to temperatures of 40° to 550° C., frequently from 200°-550° C. Similarly, such petroleum hydrocarbons are frequently employed as heating mediums on the "hot side" of heating and heating exchange systems. In both instances, the petroleum hydrocarbon liquids are subjected to elevated temperatures which produce a separate phase known as fouling deposits, within the petroleum hydrocarbon. In all cases, these deposits are undesirable by-products. In many processes, the deposits reduce the bore of conduits and vessels to impede process throughput, impair thermal transfer, and clog filter screens, valves and traps. In the case of heat exchange systems, the deposits form an insulating layer upon the available surfaces to restrict heat transfer and necessitate frequent shut-downs for cleaning. Moreover, these deposits reduce throughput, which of course results in a loss of capacity with a drastic effect in the yield of finished product. Accordingly, these deposits have caused considerable concern to the industry.

While the nature of the foregoing deposits defies precise analysis, they appear to contain either a combination of carbonaceous phases which are coke-like in nature, polymers or condensates formed from the petroleum hydrocarbons or impurities present therein and/or salt formations which are primarily composed of magnesium, calcium and sodium chloride salts. The catalysis of such condensates has been attributed to metal compounds such as copper or iron which are present as impurities. For example, such metals may accelerate the hydrocarbon oxidation rate by promoting degenerative chain branching, and the resultant free radicals may initiate oxidation and polymerization reactions which form gums and sediments. It further appears that the relatively inert carbonaceous deposits are entrained by the more adherent condensates or polymers to thereby contribute to the insulating or thermal opacifying effect.

Fouling deposits are equally encountered in the petrochemical field wherein the petrochemical is either being produced or purified. The deposits in this environment are primarily polymeric in nature and do drastically affect the economies of the petrochemical process. The petrochemical processes include processes ranging from those where ethylene or propylene, for example, are obtained to those wherein chlorinated hydrocarbons are purified.

Other somewhat related processes where antifoulants may be used to inhibit deposit formation are the manufacture of various types of steel or carbon black.

SUMMARY OF THE INVENTION

In accordance with the invention, enaminones of polyalkenylsuccinimides are used to inhibit fouling of heated liquid hydrocarbon mediums. Typically, such antifoulant protection is provided during heat processing of the medium, such as in refinery, purification, or production processes.

The enaminones are prepared via reaction of a polyalkenylsuccinimide with a dicarbonyl compound. The polyalkenyl succinimide intermediate may be prepared by reacting polyalkenylsuccinic anhydride with a polyamine, preferably triethylenetetramine, or other polyethyleneamine. Conversely, a variety of the polyalkenylsuccinimides are also commercially available and can be used directly as a reactant in combination with the dicarbonyl reactant to produce the desired enaminone.

PRIOR ART

Enaminones of polyalkenylsuccinimide are disclosed in U.S. Pat. No. 4,579,675 (Sawicki et al). In accordance with this disclosure, the disclosed enaminones are useful as dispersants-detergents in oleaginous compositions. Efficacy is assessed by use of a Bench V-C test as specified in U.S. Pat. No. 4,248,719 (Chafetz et al), with the Chevrolet Carburetor Detergency test set forth in U.S. Pat. No. 4,177,041; and the Buick Detergency Test specified in U.S. Pat. No. 4,204,841. These tests are designed to test the dispersancy function of a candidate material in a multigrade (10W-30) automotive oil or the detergency function of the candidate material in a gasoline blend. In contrast, the present invention calls for inhibition of fouling in liquid hydrocarbonaceous mediums during the high temperature processing of the medium. Studies have indicated that many compounds known to be useful as lubricating oil detergent-dispersants do not adequately function as process antifoulants during heat treatment processing of the treated medium.

Of further possible interest to the use of succinic acid and succinic anhydride derivatives is U.S. Pat. No. 3,235,484 (Colfer et al) which discloses amine reaction products of succinic acid and succinic anhydrides. These materials are used to inhibit carbonaceous material formation in refinery cracking units. U.S. Pat. No. 3,172,892 (LeSuer et al) teaches the use of high molecular weight succinimides as dispersants in lubricating compositions with Gonzalez in U.S. Pat. No. 3,437,583 teaching combinations of metal deactivator, phenolic compound, and substituted succinic acid or anhydride used to inhibit fouling in hydrocarbon process fluids.

One particularly successful group of antifoulants is reported in U.S. Pat. No. 4,578,178 (Forester—of common assignment herewith). This patent discloses the use of polyalkenylthiophosphonic acid esters as antifoulants in heat treated hydrocarbon mediums with the Group II(a) cation salts of such acids being specified in U.S. Pat. No. 4,775,459 (Forester—of common assignment herewith).

DETAILED DESCRIPTION

I have found that enaminone derivatives of polyalkenylsuccinimide, as disclosed in U.S. Pat. No. 4,579,675 (Sawicki et al), provide significant antifoulant efficacy in liquid hydrocarbonaceous mediums during the high temperature treatment of the medium. It is to be understood that the phrase "liquid hydrocarbonaceous medium" as used herein signifies various and sundry petroleum hydrocarbon and petrochemicals. For instance, petroleum hydrocarbons such as petroleum hydrocarbon feedstocks including crude oils and fractions thereof such as naphtha, gasoline, keresene, diesel, jet fuel, fuel oil, gas oil, vacuum residua, etc., are all included in the definition.

Similarly, petrochemicals such as olefinic or naphthenic process streams, aromatic hydrocarbons and their derivatives, ethylene dichloride, and ethylene glycol are all considered to be within the ambit of the phrase "liquid hydrocarbonaceous mediums".

The enaminone derivatives of polyalkenylsuccinimide useful in the invention are generally prepared from reaction of polyalkenylsuccinic anhydride with a polyamine with attendant heating to drive off water so as to form the requisite polyalkenylsuccinimide intermediate. After the intermediate is formed, it is reacted with a dicarbonyl compound under an inert atmosphere in a non-polar organic solvent, such as toluene, xylene, benzene, etc.

More specifically, the starting reactant, polyalkenylsuccinic anhydride may be purchased commercially or prepared. Presently, it is preferred to buy this from Texaco. One such polyalkenylsuccinic anhydride is presently sold under the designation TLA-627. It is a polyisobutenylsuccinic anhydride (PIBSA) having the structure

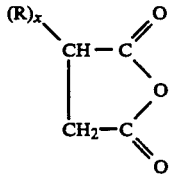

(I)

wherein, in this case, R is an isobutenyl repeat unit. The average molecular weight of the polyisobutene used to produce the PIBSA is about 1300.

The precursor polyalkenylsuccinic anhydride may also be prepared as reported in U.S. Pat. No. 3,235,484 (Colfer), incorporated herein by reference or, more preferably, by the methods reported in U.S. Pat. No. 4,883,886 (Huang) also incorporated by reference herein. As to the Colfer method, the anhydrides are formed from reaction of maleic anhydride with a high molecular weight olefin or a chlorinated high molecular weight olefin. In the preferred Huang method, reaction of a polymer of a $C_2$–$C_8$ olefin and maleic anhydride are carried out in the presence of a tar and side product suppressing agent.

The most commonly used sources for forming the aliphatic R substituent on the succinic anhydride compound (I) are the polyolefins, such as polyethylene, polypropylene, polyisobutene, polyamylene, polyisohexylene, etc. The most particularly preferred polyolefin (and the one used to manufacture the polyisobutenylsuccinic anhydride presently available from Texaco) is polyisobutene. Particular preference is made for such a polyisobutene-containing at least about 50 carbon atoms, preferably from at least 60 carbon atoms and most desirably from about 100 to about 130 carbon atoms. Accordingly, an operable carbon atom number range for R is from about 30–200 carbon atoms.

Once the polyalkenylsuccinic anhydride precursor is obtained, it is reacted with a polyamine, as reported in Colfer, at temperature in excess of about 80° so as to form an imide. More specifically, the polyalkenylsuccinic anhydride

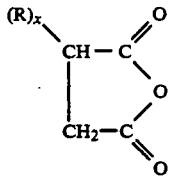

(I)

wherein R is an aliphatic alkenyl or alkyl moiety having at least about 50 carbon atoms and less than about 200 carbon atoms, is reacted with a polyamine having the structure

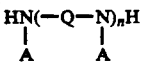

(II)

in which n is an integer, A is chosen from hydrocarbyl, hydroxyalkyl or hydrogen with the proviso that at least one A is hydrogen. Q signifies a divalent aliphatic radical. As Colfer indicates, the A substituents can be considered as forming a divalent alkylene radical, thus resulting in a cyclic structure. Q generally, however, is ($C_1$–$C_5$) alkylene, such as ethylene, trimethylene, tetramethylene, etc. Q is most preferably ethylene.

Accordingly, exemplary amine components may comprise ethylenediamine, triethylenetetramine, diethylenetriamine, trimethylenediamine, bis(trimethylene)triamine, tris(trimethylene)tetramine, tris(hexamethylene)tetramine, decamethylenediamine, N-octyl trimethylenediamine, N,N'-dioctyltrimethylenediamine, N-(2-hydroxyethyl)ethylenediamine, piperazine, 1-(2-aminopropyl)piperazine, 1,4-bis(2-aminoethyl)piperazine, 1-(2-hydroxyethyl)piperazine, bis(hydroxypropyl)substituted tetraethylenepentamine, N-3-(hydroxypropyl)tetramethylenediamine, pyrimidine, 2-methylimidazoline, polymerized ethyleneimine, and 1,3-bis(2-aminoethyl)imidazoline.

The reaction of precursor polyalkenyl succinic anhydride (I) with amine (II) is conducted at temperature in excess of 80° C. with use of a solvent, such as benzene, xylene, toluene, naphtha, mineral oil, n-hexane, etc. Preferably, the reaction is conducted at from 100°–250° C. with a molar amount of precursor anhydride (I): amine (II) being from about 1:5 to about 5:1 with a molar amount of 1–3:1 being preferred.

After the polyalkenylsuccinimide precursor has been obtained, it is reacted with a dicarbonyl compound as reported in U.S. Pat. No. 4,579,675 (Sawicki et al.)—herein incorporated by reference to form the desired enaminone of the polyalkenylsuccinimide. As to the dicarbonyl compound that may be reacted with the polyalkenylsuccinimide, this is represented by the formula

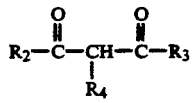

(III)

wherein $R_2$ is an alkyl ($C_1$–$C_{20}$) or substituted alkyl ($C_1$–$C_{20}$) group. For example, $R_2$ can comprise an oxo substituted alkyl having 1 to 20 carbon atoms, with $R_3$ being selected from lower alkyl ($C_1$–$C_5$), or oxyalkyl ($C_1$–$C_5$) having from 1 to 5 carbon atoms, oxyalkenyl having 1 to 5 carbon atoms or OH. $R_4$ is selected from H or phenyl. Exemplary compounds include acetoacetic acid, 3-oxo-2-phenylbutanoic acid, allyl acetoacetate, and 2,4,6,-heptanetrione. Preferably, the dicarbonyl compound is a 1,3 dioxo compound selected from the group of methylacetoacetate, ethylacetoacetate and 2,4-pentandione. Most preferably, ethylacetoacetate is the chosen dicarbonyl reactant.

As is reported in the '675 Sawicki et al patent, the dicarbonyl reactant (III) is added to the polyalkenylsuccinimide in an inert atmosphere in a non-polar organic solvent, such as toluene in the presence of an acid catalyst, such as p-toluenesulfonic acid. Preferably, about equimolar amounts of the polyalkenylsuccinimide and dicarbonyl (III) materials are employed with the reaction medium being heated to temperatures of from about 90°–120° C. for about 4–6 hours with attendant stirring. The end product, enaminone of polyalkenylsuccinimide, can be isolated via conventional techniques as noted in the '675 patent.

At present, preliminary studies have indicated surprisingly effective antifouling inhibition results with an enaminone derivative of a polyalkenyl succinimide formed from a 2:1 molar ratio of polyisobutenylsuccinic anhydride (mw isobutenyl moiety ≈1300) and triethylenetetramine (TETA).

This particular polyisobutenylsuccinimide is then reacted with ethylacetoacetate in accordance with the Example VI of U.S. Pat. No. 4,579,675 to produce the preferred enaminone of TETA-polyisobutenylsuccinimide product used in accordance with the invention.

The enaminones of polyalkenyl succinimide useful in the invention may be added to or dispersed within the liquid hydrocarbonaceous medium in need of antifouling protection in an amount of 0.5–10,000 ppm based upon one million parts of the liquid hydrocarbonaceous medium. Preferably, the antifoulant is added in an amount of from 1 to 2500 ppm.

The enaminones of polyalkenyl succinimide may be dissolved in a polar or non-polar organic solvent, such as heavy aromatic naphtha, toluene, xylene, or mineral oil and fed to the requisite hot process fluid or they can be fed neat thereto. These derivatives are especially effective when added to the liquid hydrocarbonaceous medium during the heat processing thereof at temperatures of from 100°–550° C.

The following examples are included as being illustrative of the invention and should not be construed as limiting the scope thereof.

EXAMPLES

Preparation (PBSE) A starting polyisobutenyl succinimide was prepared by reacting polyisobutenylsuccinic anhydride (average mol. wt.≈1300 polyisobutenyl moiety) with triethylenetetramine in a 2:1 molar ratio. Then, the resulting polyisobutenyl succinimide was reacted with ethylacetoacetate according to the disclosure of Example VI of U.S. Pat. No. 4,579,675 to yield a 50% active product diluted with mineral oil (Mentor 28).

Efficacy

In order to ascertain the efficacy of the candidate enaminones in inhibiting deposit formation in liquid hydrocarbonaceous mediums during elevated temperature treatment, test materials were subjected to a dual fouling apparatus test. In the dual fouling apparatus, process fluid (crude oil) is pumped from a Parr bomb through a heat exchanger containing an electrically heated rod. Then the process fluid is chilled back to room temperature in a water-cooled condenser before being remixed with the fluid in the bomb.

The Dual Fouling Apparatus (DFA) used to generate the data shown in the following Tables I and II contain two independent, heated rod exchangers. In the DFA tests, rod temperature was controlled while testing. As fouling on the rod occurs, less heat is transferred to the fluid so that the process fluid outlet temperature decreases. Antifoulant protection was determined by comparing the summed areas between the heat transfer curves for control and treated runs and the ideal case for each run. In this method, the temperature of the oil inlet and outlet and rod temperatures at the oil inlet (cold end) and outlet (hot end) are used to calculate U-rig coefficients of heat transfer every 2 minutes during the tests. From these U-rig coefficients, areas under the fouling curves are calculated and subtracted from the non-fouling curve for each run. Comparing the areas of control runs (averaged) and treated runs in the following equation results in a percent protection value for antifoulants.

$$\frac{\text{Avg. }\Delta\text{Area (control)} - \Delta\text{Area (treatment)}}{\text{Avg. }\Delta\text{Area (control)}} \times 100 = \%\text{ protection}$$

TABLE I

| Desalted Crude Oil A 482° C. Rod Temperature | |
|---|---|
| Additive (ppm) | % protection |
| PIBSI (62.5) | 8 (avg.) |
| (250) | 18 |
| PBSE (62.5) | 27 |
| (250) | 24 |

PIBSI = polyisobutenylsuccinimide mw isobutenyl moiety ≈ 1300 available Lubrizol
PBSE = enaminone of polyisobutenylsuccinimide mw isobutenyl moiety ≈ 1300 made in accord with the preparation example, supra.

Additional tests with the dual fouling apparatus were undertaken to confirm the test results reported in Table I supra., these test results are reported in Table II.

TABLE II

| Desalted Crude Oil | | | | |
|---|---|---|---|---|
| Crude Oil Type | Additive | PPM Active | Rod Temperature °C. | % Protection |
| B | PIBSI | 250 | 454 | 17 |
| | PBSE | 250 | 454 | 31 |
| C | PIBSI | 250 | 413 | 42 |
| | PBSE | 250 | 413 | 37 |
| D | PIBSI | 250 | 316 | 9 |
| | PBSE | 250 | 316 | 100 |
| | PIBSI | 500 | 316 | 33, 97 (85 avg.) |
| | PBSE | 500 | 316 | 30 |

PIBSI and PBSE are the same as in Table 1.

Another series of tests adapted to assess candidate efficacy in providing fouling inhibition during high temperature treatment of liquid hydrocarbon mediums were performed. These tests are titled the "Hot Filament Fouling Tests" and were run in conjunction with gas oil hydrocarbon mediums. The procedure for these tests involves the following:

Hot Filament Fouling Tests (HFFT)

A preweighed 24-gauge Ni-chrome wire is placed between two brass electrodes in a glass reaction jar and held in place by two brass screws. 200 mls of feedstock are measured and added into each sample jar. One sample jar is left untreated as a control with other jars being supplied with either 31 or 125 ppm (active) of the candidate material. The brass electrode assembly and lids are placed on each jar and tightly secured. The treatments are mixed via swirling the feedstock. Four sample jars are connected in series with a controller provided for each series of jars.

The controllers are turned on and provide 8 amps of current to each jar. This amperage provides a temperature of about 125°-150° C. within each sample jar. After 24 hours of current flow, the controllers are turned off and the jars are disconnected from their series connection. The wires, which have been immersed in the hot medium during the testing, are carefully removed from their jars, are washed with xylene and acetone, and are allowed to dry.

Each wire and the resulting deposits thereon are weighed with the weight of the deposit being calculated. Photographs of the wires are taken comparing untreated, treated, and clean wires from each series of experiments using a given controller.

The deposit weight for a given wire was calculated in accordance with $$\text{wt. deposit} = \left(\begin{matrix}\text{weight of wire}\\ \text{plus deposit}\end{matrix}\right) - (\text{original wire weight})$$

The precentage protection for each treatment sample was then calculated as follows:

$$\%\ \text{protection} = \left[1 - \frac{\text{wt. deposit (treated)}}{\text{wt. deposit (untreated)}}\right] \times 100$$

Results are shown in Table III.

TABLE III

| Additive | ppm Actives | Feedstock Type | % Protection |
|---|---|---|---|
| PIBSI | '31 | SRLGO | 78 |
| PBSE | 31 | SRLGO | 50 |
| PIBSI | 125 | SRLGO | 40 avg. |
| PBSE | 125 | SRLGO | 72 |
| PIBSI | 125 | CCLGO | 89 avg. |
| PBSE | 125 | CCLGO | 96 |

In Table III, SRLGO means straight run light gas oil from a midwestern refinery with CCLGO indicating a catalytic cracked light gas oil from the same midwestern refinery.
PIBSI and PBSE are the same as per Table I.

As can be seen by the above efficacy samples, the polyalkenylsuccinimide enaminone prepared as per above is, in most instances, more effective in inhibiting fouling of the test heated liquid hydrocarbonaceous medium than the commercially available polyisobutenylsuccinimide.

In accordance with the patent statutes, the best mode of practicing the invention has been set forth. However, it will be apparent to those skilled in the art that many other modifications can be made without departing from the invention herein disclosed and described.

I claim:

1. A method of inhibiting fouling deposit formation in a liquid hydrocarbonaceous medium during heat treatment processing thereof at temperatures of from about 200° C.-550° C., wherein, in the absence of such antifouling treatment, fouling deposits are normally formed as a separate phase within said heated liquid hydrocarbonaceous medium impeding process throughput and thermal transfer, said method comprising adding to said liquid hydrocarbonaceous medium, an antifouling amount of from about 0.5-10,000 parts by weight of an enaminone of a polyalkenylsuccinimide based upon one million parts of said hydrocarbonaceous medium, said enaminone of a polyalkenylsuccinimide being formed by a first reaction of a polyalkenylsuccinic anhydride having the formula

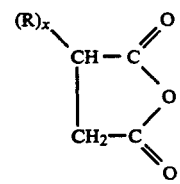

(I)

wherein R is an aliphatic alkenyl or alkyl moiety having at least 50 carbon atoms and less than about 200 carbon atoms, with a polyamine, said polyalkenylsuccinimide then being reacted with a dicarbonyl compound having the formula

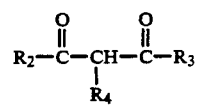

(III)

wherein $R_2$ is $C_1$-$C_{20}$ alkyl or substituted $C_1$-$C_{20}$ alkyl, $R_3$ is $C_1$-$C_5$ alkyl, oxy-$C_1$-$C_5$ alkyl, or OH and $R_4$ is H or phenyl; to form said enaminone.

2. A method as recited in claim 1 wherein said liquid hydrocarbonaceous medium comprises crude oil, straight run gas oil, or catalytically cracked light gas oil.

3. A method as recited in claim 1 wherein R comprises a polyalkenyl moiety.

4. A method as recited in claim 3 wherein R comprises a repeated isobutenyl moiety.

5. A method as recited in claim 4 wherein said polyamine is a polyethyleneamine.

6. A method as recited in claim 5 wherein said polyethyleneamine is triethylenetetramine.

7. A method as recited in claim 1 wherein said dicarbonyl compound is a member selected from the group of ethylacetoacetate, methylacetoacetate, and 2,4-pentandione.

8. A method as recited in claim 1 wherein said dicarbonyl compound is ethylacetoacetate.

* * * * *